US005898173A

United States Patent [19]

Franzen

[11] Patent Number: 5,898,173

[45] Date of Patent: Apr. 27, 1999

[54] HIGH RESOLUTION ION DETECTION FOR LINEAR TIME-OF-FLIGHT MASS SPECTROMETERS

[75] Inventor: Jochen Franzen, Bremen, Germany

[73] Assignee: Bruker Daltonik GmbH, Bremen, Germany

[21] Appl. No.: 08/920,584

[22] Filed: Aug. 29, 1997

[30] Foreign Application Priority Data

Sep. 3, 1996 [DE] Germany ..... 196 35 645

[51] Int. Cl.[6] ..... H01J 49/40

[52] U.S. Cl. ..... 250/287

[58] Field of Search ..... 250/287, 281, 250/282

[56] References Cited

U.S. PATENT DOCUMENTS

| | | | |
|---|---|---|---|
| 5,160,840 | 11/1992 | Vestal | 250/287 |
| 5,654,544 | 8/1997 | Dresch | 250/287 |
| 5,689,111 | 11/1997 | Dresch et al. | 250/287 |
| 5,696,375 | 12/1997 | Park et al. | 250/287 |

FOREIGN PATENT DOCUMENTS

| | | |
|---|---|---|
| 1498664 | 5/1969 | Germany . |
| 3940900 | 6/1990 | Germany . |
| 908490 | 10/1962 | United Kingdom . |
| 2233149 | 6/1989 | United Kingdom . |

OTHER PUBLICATIONS

S. Richter et al., *Int. J. Mass Spectrom.Ion Processes* 136(1994), pp. 91–100.

David E. Schilke and Robert J. Levis, *A Laser Vaporization, Laser Ionization Time–Of–Flight Mass Spectrometer For The Probing Of Fragile Biomolecules*, Rev.Sci.Instrum. 65(6), Jun. 1994, American Institute of Physics, pp. 1903–1911.

*Primary Examiner*—Kiet T. Nguyen

[57] ABSTRACT

A high resolution linear tine-of-flight mass spectrometer consists of clearing the analyte ions to be detected of neutral and charged fragments by applying of an electrical deflection perpendicular to the flight direction in conjunction with a direction-filtering diaphragm, in order to avoid smearing of the signal by their deviations in velocity. The mass spectrometer simultaneously allows the ions to be post-accelerated to very high energies before detection without a grid. In this way it is possible to reduce the acceleration energy of the ions before the flight path so that the high resolution is also measurable in practice due to increased flight times.

8 Claims, 1 Drawing Sheet

HIGH RESOLUTION ION DETECTION FOR LINEAR TIME-OF-FLIGHT MASS SPECTROMETERS

FIELD OF THE INVENTION

The invention relates to ion detection with high resolving power in a linear time-of-flight mass spectrometer. It especially relates to the cleaning of the ion beam from accompanying neutral or charged fragments of the analyte ions.

PRIOR ART

In the concurrent patent application BFA 45/96, the description of which is to be included here in full, a linear time-of-flight spectrometer is presented which can achieve extremely high resolution even for very large ion masses by means of second order focusing. This resolving power, achievable hitherto only through computer simulation, cannot be verified in practice since various influences limit the attainable resolution.

One of the main reasons for the practical limitation in resolving power lies in the fact that, in the ion source used for generating of large ions from corresponding analyte substances, a great number of metastable ions are produced which decompose in the flight path after leaving the ion source, forming both neutral and charged fragments. This process has become known, especially for the method of ionization by matrix-assisted laser desorption and ionization ("MALDI"), as "post source decay" (PSD). The fragments formed during metastable decomposition essentially continue to fly at the same velocity as the nondecomposed analyte ions. They therefore reach the detector located at the end of the flight path at approximately the same time as the nondecomposed ions of the same start mass and amplify, in principle, their detected signal.

During metastable decomposition of ions, however, these fragments receive kinetic energies of several tenths of an electron volt which lead either to a slight transverse acceleration, a deceleration, or to an acceleration of the fragments, depending on the direction of decomposition. Consequently, besides a slight local smearing, a temporal smearing of the ion signal can be observed at the detector, and the mass resolution is reduced.

Metastable decomposition follows a declining exponential function. More decompositions therefore take place shortly after leaving the ion source than later. These early decompositions however widen the mass signal more strongly, since the slight velocity deviation received during decomposition becomes noticeable over a longer flight path as a larger time-of-flight deviation.

The exact ionization process, particularly that of MALDI, and the attainment of high resolution through delayed dynamic acceleration are described in the aforementioned patent application BFA 46/96.

In order to efficiently utilize and measure the high resolution which can be achieved using the method mentioned here, it is possible in principle to reduce the flight times by decreasing the accelerating voltage. If, for example, the accelerating voltage is quartered, the flight time is then doubled. Influences of the detector on the signal width of the ion masses diminish (modem multichannel electron multipliers themselves generate signal widths between 1 and 3 nanoseconds). However, this method has the disadvantage that it reduces the sensitivity of the detector for the detection of large ion masses drastically if there is no post-acceleration of the ions. In addition, at lower ion energies, the relative widening of the signal due to the metastable decompositions becomes stronger and the resolution gets worse.

Post-acceleration of ions has been attempted in different ways, but has proven regularly unsuccessful. The attempts were generally abandoned. Post-acceleration requires a well-defined start location which was normally generated through a grid a short distance in front of the detector. Post-acceleration therefore took place between the grid and the detector. However, both grids and ion fragments in the ion beam generate ghost signals. Ions that hit the grid decompose and lead to a first type of ghost signal before the main signal, due to grid-generated fragment ions which are brought to a higher velocity in the post-acceleration path. But also the metastably generated neutral fragments, which are not subject to post-acceleration, generate ghost signals. And the metastably generated fragment ions produce other, very complex ghost signals in the post-acceleration path, all the way to a quasi-continuous background noise. Both of the last-named types of ghost signals also result from gridless diaphragm arrangements for post-acceleration.

OBJECTIVE OF THE INVENTION

It is the objective of the invention to find a detector arrangement which separates decomposed and nondecomposed analyte ions and which can measure the nondecomposed ions with highest resolution and highest sensitivity.

BRIEF DESCRIPTION OF THE INVENTION

It is the basic idea of the invention to make the ion beam as parallel as possible and then deflect it laterally through an electrical field in such a way that the velocity of the ions in the axial direction of the flight path is not disturbed. Through appropriate masking, the nondecomposed ions can then be separated from the neutral fragments and from decomposed daughter ions, and can also be detected separately. The detector surface must be aligned exactly perpendicular to the axial direction of the flight path before deflection. Slight residual disturbances to the forward velocity during transverse deflection through the electrical field become even less significant the closer the deflection device is arranged to the detector. On the other hand, the deflection device must be located as far as possible from the detector in order to obtain good directional masking. However it is not difficult for the specialist to find a favorable compromise in the distance for this specific task.

It is a further idea of the invention to bring the masked, nondecomposed ions to very high kinetic energies using a gridless post-acceleration in a relatively short post-acceleration path to in order to arrive at sufficient sensitivity for high ion masses.

It is a further idea of the invention to also measure the neutral fragments which continue to fly in a straight forward direction using a second detector, in order to receive information about the stability of the analyte ions.

Also, partial streams of daughter ions from metastable decompositions can be measured in other detectors, however only nonspecific information can be obtained regarding their mass.

Figure 1:
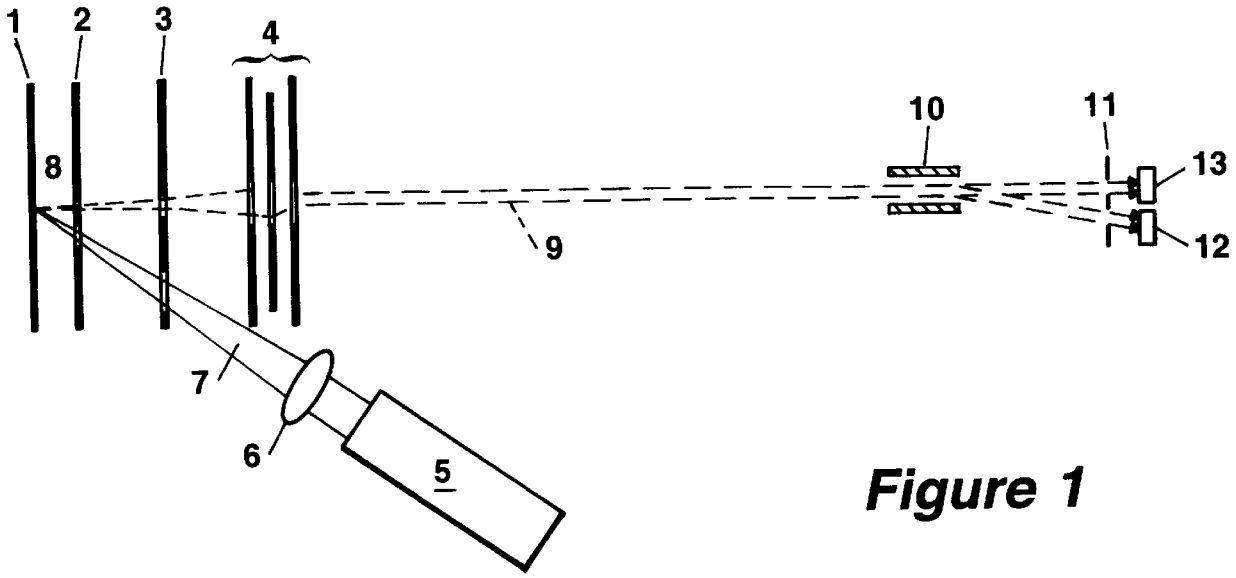
FIG. 1 shows the principle design of a linear time-of-flight mass spectrometer with high resolution ion detection according to this invention.

Sample support electrode 1 carries the analyte substance 8 applied to its surface. A light flash from laser 5 is focused by lens 6 into a convergent light beam 7 onto sample 8. The light flash generates ions of the analyte substance in a MALDI process which are dynamically accelerated after a time lag in the space between sample support 1 and the intermediate acceleration electrode 2, accelerated again in the space between the intermediate acceleration electrode 2 and the base electrode 3 and shot into the flight path of the mass spectrometer located between base electrode 3 and ion detector 12. Einzel lens 4 makes ion beam 9 parallel.

In order to filter out the nondecomposed analyte ions, ion beam 9 is deflected laterally in the plate capacitor 10 and cleared of decomposed fragment ions, which are more strongly deflected (not shown in FIG. 1), through direction-filtering diaphragm 11. These nondecomposed ions are measured in detector 12.

The neutral fragments may also be measured in a straight forward direction using a second detector 13.

Figure 2:
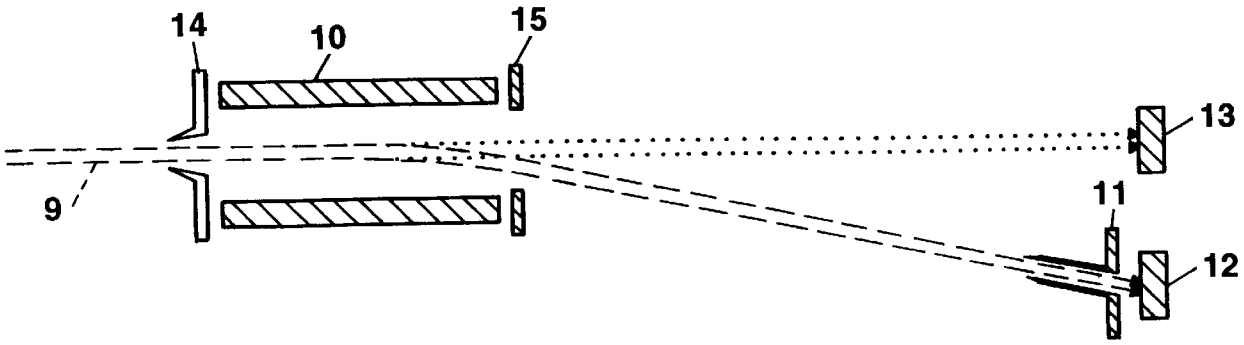

FIG. 2 shows closer details of this invention. Thus the central main part of parallel ion beam 9 can be masked with relative precision in front of the plate capacitor 10 by means of a diaphragm 14 designed like a skimmer. Diaphragm 14 and terminating diaphragm 15 make up so-called Herzog shunts which limit the electrical fringing fields of the plate capacitor and its negative effects on the ion beam 9. Diaphragm 11 is also designed as a skimmer here in order to reduce the effect of possible surface charges on the ion beam. Between diaphragm 11 (which is located shortly before ion detector 12) and ion detector 12, a high voltage for post-acceleration of the ions can be applied without any disadvantage in order to increase ion detection sensitivity.

PARTICULARLY FAVORABLE EMBODIMENTS

FIG. 1 shows the principle design of a linear time-of-flight mass spectrometer with ion detection according to this invention. The time-of-flight mass spectrometer has a MALDI ion source with an intermediate diaphragm such as can be used to generate high resolution. Here a gridless ion source with a subsequent Einzel lens is represented which is especially suited for generation of a parallel ion beam without any small-angle scatterings. The invention is however not solely limited to this arrangement, and mass spectrometers with other types of ion sources, and even ion sources with grids, can be improved by this invention in the time and mass resolution of their ion detection.

The generation of ions and particulary their time focusing, which leads to high resolution, will not be described here in detail. This can be read in the aforementioned patent application BFA 45/96.

The ion beam, made very parallel by the grid (or in case of a gridless ion source by lens 4) is laterally deflected according to this invention in plate capacitor 10. A plate capacitor is used which has no electrical field strength at all in its interior in the original flight direction of the ions, so that the ions do not receive any additional velocity in the axial direction of the flight path. The field strengths in the axial direction, unavoidably present at the entrance and exit due to the capacitor's leakage fields, can be minimized in a known manner using ion-optical auxiliary elements 14 and 15, so-called Herzog shunts for leakage field short circuits. The deflected ion beam fans out, and the nondecomposed ions, which are the heaviest, then form the ion beam nearest the axis. The fragment ions whose energy has become reduced according to the splitting off of mass, are more strongly deflected. The nondecomposed ion can now be masked by a diaphragm and measured by detector 12.

The detector surface must naturally be aligned exactly perpendicular to the original flight direction since only the flight time of the ions in this original direction is to be measured.

Masking of the nondecomposed ions cannot always be complete. For one, fragment ions which result from decompositions after passage through the plate capacitor cannot be masked. This will therefore always contribute to time smearing. However since the path from decomposition to detection is not very long, the slight velocity differences due to the decomposition energy will only have a minor influence.

Secondly, fragment ions which have only lost a very light neutral fragment, for example hydrogen (mass 2 u) or even water (mass 18 u), can also not be completely masked. In this case, however, the heavy fragment ion has received only a tiny velocity change according to the principle of conservation of momentum, therefore it also contributes only very little to time smearing. The resolution of the direction and mass filtration by the diaphragm is relative to the width of the parallel ion beam. By limiting the beam to a narrow core area through diaphragm 14 in front of the plate capacitor, the mass resolution can be optimized. This diaphragm 14 is most practically designed as a skimmer, so that possible surface charges cannot influence the ion beam.

Transverse deflection with masking of nondecomposed ions is therefore a good means of eliminating time smearing by fragments.

The neutral fragments are not deflected by the capacitor and continue to fly straight ahead. They can be measured in this direction with their own detector. The spectrum of the split-off neutral fragments is certainly very interesting. Although the masses of the neutral fragments are not measured, one may obtain information about which of the stably measured ions has suffered losses due to the metastable process.

Also the more strongly deflected fragment ions can be detected in principle by their own detectors.

An especially interesting aspect of this arrangement is that it is now possible to post-accelerate the ions almost without the occurrence of host signals. For example, ions in the ion source can be accelerated with only 6 kilovolts, in the post-acceleration path, however, at 50 kilovolts. In this way flight time is longer and a higher time resolution can be achieved with equal time smearing of the detector. The ion source must frequently be vented, and samples must be introduced, therefore the use of high voltage in the ion source region is much more difficult than in the detector region, which can always be maintained at an ultrahigh vacuum.

The few ghost signals remaining due to the above listed reasons can, for example, be recognized by comparison of the ion spectrum with the neutral fragment spectrum and thus eliminated.

The time-variable ion current given by the ion beam is measured and digitalized at the detector usually at a measuring rate of 1 or 2 gigahertz. Transient recorders with an even higher temporal resolution will soon be available. Usually measurement values from several scans are cumulated before the mass lines in the stored data are sought by peak recognition methods and transformed from the time scale into mass values by application of a calibrated mass scale function.

The polarity of the high voltage being used for ion acceleration must be the same as the polarity of the ions being analyzed: positive ions are repelled by a positively charged sample support and accelerated, negative ions by a negatively charged sample support.

Of course, the time-of-flight mass spectrometer may also be operated in such a way that the path is located in a tube (not shown in FIG. 1) which is at acceleration potential U, while sample support 1 is at ground potential. In this specific case, the flight tube is at a positive potential if negatively charged ions are to be analyzed, and vice-versa This operation simplifies the design of the ion source since the isolators on the holder for exchangeable sample support 1 are no longer needed. In this case, the deflection capacitor must be operated at the high voltage of the flight path.

I claim:

1. Method for acquiring highly time-resolved mass spectra of analyte ions in a linear time-of-flight mass spectrometer, the method comprising the steps of (a) generating a substantially parallel beam of accelerated ions and directing the ion beam along a flight path toward a detection region of the spectrometer, (b) applying an energy field to the ion beam that has a force component in a direction perpendicular to the flight path of the ion beam such that a spatial mass separation of ions in the ion beam occurs in the perpendicular direction, (c) segregating analyte ions from components of the ion beam having a different mass-to-charge ratio, and (d) detecting the ion current of the segregated analyte ions.

2. Method according to claim 1, wherein the segregated analyte ions are post-accelerated prior to being detected.

3. Method according to claim 1, wherein components of the ion beam having a neutral charge are also detected.

4. Method according to claim 1, wherein fragment ions more strongly deflected by the field than the analyte ions are also detected.

5. Method according to claim 1, wherein applying an energy field comprises applying an energy field with a parallel capacitor.

6. Method according to claim 5, wherein the parallel capacitor is closed off at the entrance and exit by Herzog shunts.

7. A linear time-of-flight mass spectrometer apparatus comprising:

an ion generator that generates a substantially parallel beam of accelerated ions, including analyte ions, and directs the ion beam along a flight path toward a detection region of the spectrometer;

an ion deflector that deflects ions in a direction perpendicular to the flight path of the ions such that a spatial mass separation of ions in the ion beam occurs in the perpendicular direction;

an ion separator that segregates analyte ions from components of the ion beam having a different mass-to-charge ratio; and an ion detector that detects an ion current of the segregated analyte ions.

8. Apparatus according to claim 7 further comprising a post accelerator for accelerating the segregated analyte ions prior to their reaching the ion detector.

* * * * *